US010300698B2

(12) United States Patent
Tomizawa et al.

(10) Patent No.: US 10,300,698 B2
(45) Date of Patent: May 28, 2019

(54) LIQUID EJECTION HEAD

(71) Applicant: CANON KABUSHIKI KAISHA, Tokyo (JP)

(72) Inventors: Keiji Tomizawa, Yokohama (JP); Masataka Sakurai, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,651

(22) Filed: May 30, 2018

(65) Prior Publication Data

US 2018/0345668 A1 Dec. 6, 2018

(30) Foreign Application Priority Data

Jun. 5, 2017 (JP) ..... 2017-110768
Apr. 9, 2018 (JP) ..... 2018-074745

(51) Int. Cl.
*B41J 2/14* (2006.01)

(52) U.S. Cl.
CPC ..... *B41J 2/14129* (2013.01); *B41J 2/1404* (2013.01); *B41J 2/1412* (2013.01); *B41J 2/14072* (2013.01); *B41J 2202/18* (2013.01)

(58) Field of Classification Search
CPC ..... B41J 2/1404; B41J 2/14145; B41J 2002/14467; B41J 2002/14387; B41J 2/1433; B41J 2002/14475; B41J 2002/14185
USPC ..... 347/20, 62, 63, 65
See application file for complete search history.

(56) References Cited

U.S. PATENT DOCUMENTS

| | | | |
|---|---|---|---|
| 5,204,689 | A | 4/1993 | Shirato et al. |
| 6,971,736 | B2 | 12/2005 | Tomizawa et al. |
| 6,984,026 | B2 | 1/2006 | Tomizawa et al. |
| RE40,994 | E | 11/2009 | Murakami et al. |
| 7,628,472 | B2 | 12/2009 | Tomizawa et al. |
| 7,938,511 | B2 | 5/2011 | Tomizawa et al. |
| 7,963,635 | B2 | 6/2011 | Oikawa et al. |
| 7,980,663 | B2 | 7/2011 | Matsumoto et al. |
| 8,033,651 | B2 | 10/2011 | Tomizawa et al. |
| 8,083,318 | B2 | 12/2011 | Tsuchii et al. |

(Continued)

FOREIGN PATENT DOCUMENTS

| | | |
|---|---|---|
| JP | 2016-068339 A | 5/2016 |
| JP | 2016-137705 A | 8/2016 |

OTHER PUBLICATIONS

Extended European Search Report dated Oct. 18, 2018, in European Patent Application No. 18175709.7.

*Primary Examiner* — An H Do
(74) *Attorney, Agent, or Firm* — Venable LLP

(57) ABSTRACT

A liquid ejection head includes a substrate, a heat generating resistor element arranged on the substrate and a flow channel forming member for forming a flow channel. The flow channel forming member has a side wall surrounding at least part of the heat generating resistor element. The heat generating resistor element has a pair of oppositely disposed sides and a pair of electrical connection regions which extend along the respective ones of the pair of sides and are separated from the respective ones of the pair of sides by a distance. The side wall has at least one concave corner which is comprised of a curved surface or a surface extending obliquely to the pair of sides and the heat generating resistor element has at least one convex corner which faces the at least one concave corner of the side wall and is rounded or chamfered.

20 Claims, 11 Drawing Sheets

(56) References Cited

U.S. PATENT DOCUMENTS

| | | | |
|---|---|---|---|
| 8,087,759 | B2 | 1/2012 | Oikawa et al. |
| 8,162,446 | B2 | 4/2012 | Tomizawa et al. |
| 9,731,503 | B2 | 8/2017 | Kodoi et al. |
| 9,889,650 | B2 | 2/2018 | Kodoi et al. |
| 2016/0136957 | A1 | 5/2016 | North et al. |
| 2016/0214384 | A1 | 7/2016 | Kasai et al. |

LIQUID EJECTION HEAD

BACKGROUND OF THE INVENTION

Field of the Invention

The present invention relates to a liquid ejection head. More particularly, the present invention relates to a liquid ejection head having heat generating resistor elements.

Description of the Related Art

Recording devices for recording information in the form of images and characters on recording mediums such as sheets of paper, film or the like are being widely employed as information output devices to be used for word processors, personal computers, fax machines and so on. Japanese Patent Application Laid-Open No. 2016-137705 discloses a liquid ejection head having heat generating resistor elements to be used for a recording device of the above-described type. The disclosed liquid ejection head includes a substrate, heat generating resistor elements arranged on the substrate to generate thermal energy for ejecting liquid and an ejection port forming member having ejection ports from which liquid is ejected. Along with the substrate, the ejection port forming member forms bubble forming chambers that include heat generating resistor elements and in which liquid bubbles. With regard to each of the heat generating resistor elements, first and second electrical connection regions for supplying electric energy to the heat generating resistor element are arranged on the surface of the heat generating resistor element that faces the substrate (to be referred to as substrate-facing surface hereinafter) and an electric current flows between the first electrical connection region and the second electrical connection region. The first and second electrical connection regions are connected to respective plugs that extend from the undersides of the electrical connection regions.

If the first and second electrical connection regions are arranged on the surface of the heat generating resistor element that faces the bubble forming chamber (to be referred to as bubble forming chamber-facing surface hereinafter), an electric wiring having a large film thickness if compared with the film thickness of the heat generating resistor element needs to be formed on the bubble forming chamber-facing surface. Then, the protective film for covering the heat generating resistor element is required to have a large film thickness in order to reliably cover the step of the electric wiring that is formed along the peripheral edge of the heat generating resistor element. A thick protective film is disadvantageous from the viewpoint of efficiently conducting thermal energy from the heat generating resistor element to the liquid in the bubble forming chamber and the power consumption rate of the liquid ejection head will inevitably rise when a thick protective film is employed. Japanese Patent Application Laid-Open No. 2016-137705 describes a liquid ejection head in which first and second electrical connection regions are formed on the substrate-facing surface of each of the heat generating resistor elements. With this arrangement, no step is produced along the peripheral edge of the heat generating resistor element. Therefore, the protective film can be made to show a small film thickness and hence the power consumption rate of the liquid ejection head can be reduced if compared with known other liquid ejection heads.

For a liquid ejection head disclosed in Japanese Patent Application Laid-Open No. 2016-137705, the first and second electrical connection regions of each of the heat generating resistor elements need to be arranged at respective positions that are separated from the peripheral edge of the heat generating resistor element in order to reliably establish electrical connections between the first and second electrical connection regions and the corresponding respective plugs. However, a bubble forming region for causing film bubbling of liquid to take place can be arranged only between the first and second electrical connection regions between which an electric current flows. Differently stated, a region where no electric current flows is produced between the first and second electrical connection regions and the edge of the heat generating resistor element. Such a region is a non-heat generating region where no heat is generated. Liquid is liable to become stagnant in a non-heat generating region and, as a result, a bubble pool can easily be produced there. A bubble pool absorbs bubble forming pressure to make it difficult to produce bubble forming pressure of a desired pressure level and consequently can adversely affect the liquid ejection performance of the liquid ejection head in terms of liquid ejection capacity and liquid ejection speed. Therefore, it is desirable to minimize such a non-heat generating region.

Thus, the object of the present invention is to provide a liquid ejection head in which electrical connection regions are arranged on the substrate-facing surface of each of the heat generating resistor elements thereof and that can suppress production of a bubble pool around each of the heat generating resistor elements.

SUMMARY OF THE INVENTION

According to the present invention, there is provided a liquid ejection head including a substrate, a heat generating resistor element arranged on the substrate to generate thermal energy for ejecting liquid and a flow channel forming member for forming a flow channel for allowing liquid to flow therethrough, the flow channel forming member having a side wall surrounding at least part of the heat generating resistor element; the heat generating resistor element having a pair of oppositely disposed sides, a pair of electrical connection regions being formed on the substrate-facing surface of the heat generating resistor element in order to supply electric energy to the heat generating resistor element, the electrical connection regions extending along the respective ones of the pair of sides and separated from the respective ones of the pair of sides by a distance; the side wall having at least one concave corner comprised of a curved surface or a surface extending obliquely to the pair of sides, the heat generating resistor element having at least one convex corner facing the at least one concave corner of the side wall, the convex corner being rounded or chamfered.

Further features of the present invention will become apparent from the following description of exemplary embodiments with reference to the attached drawings.

DESCRIPTION OF THE EMBODIMENTS

Now, some currently preferred embodiments of liquid ejection head according to the present invention will be described below by referring to the accompanying drawings. While the liquid ejection heads that will be described below relate to ink jet heads that eject ink, the present invention can also be applied to liquid ejection heads that eject liquid other than ink. Note that, in the following description, the direction in which an electric current flows to a heat generating resistor element is referred to as the X-direction and the direction that is in parallel with an in-plane direction of the heat generating resistor element and orthogonal relative to the X-direction is referred to as the Y-direction. The Y-direction is in parallel with the direction in which the heat generating resistor elements or the ejection ports are arranged. The direction that is orthogonal relative to both the X-direction and the Y-direction is referred to as the Z-direction. The Z-direction is orthogonal relative to the ejection port forming surface where the ejection ports of the ejection port forming member are formed and in parallel with the direction in which liquid is ejected.

First Embodiment

Figure 1:
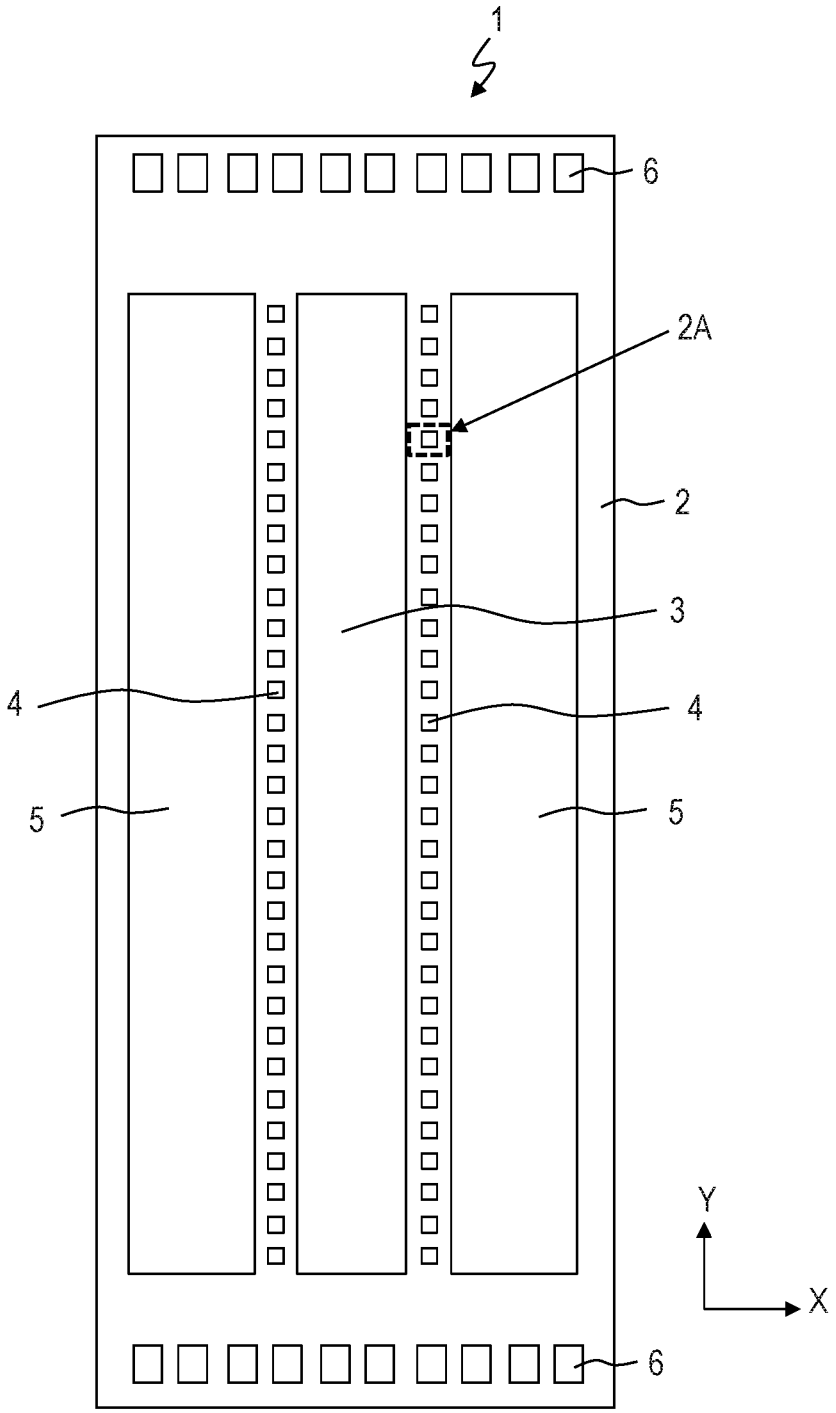
FIG. 1 is a schematic plan view of the substrate of the first embodiment of liquid ejection head according to the present invention.

FIG. 1 is a schematic plan view of the substrate of the liquid ejection head 1 of the first embodiment. Note that the ejection port forming member, which will be described hereinafter, is omitted from FIG. 1. An ink supply port 3 that extends in the longitudinal direction (in the Y-direction) is arranged in a center part of substrate 2. A plurality of heat generating resistor elements 4 that generate heat for ejecting liquid are arranged in a row along each of the opposite sides of the ink supply port 3. Additionally, drive circuits 5 for driving the heat generating resistor elements 4 are arranged along the opposite sides of the ink supply port 3 to sandwich the ink supply port 3 between them. The drive circuits 5 are electrically connected to electrode pads 6 arranged at the longitudinal (Y-direction) opposite ends of the substrate 2 to generate drive currents for driving the heat generating resistor elements 4 according to the recording signals supplied from the outside of the liquid ejection head 1 by way of the electrode pads 6.

Figure 2A:
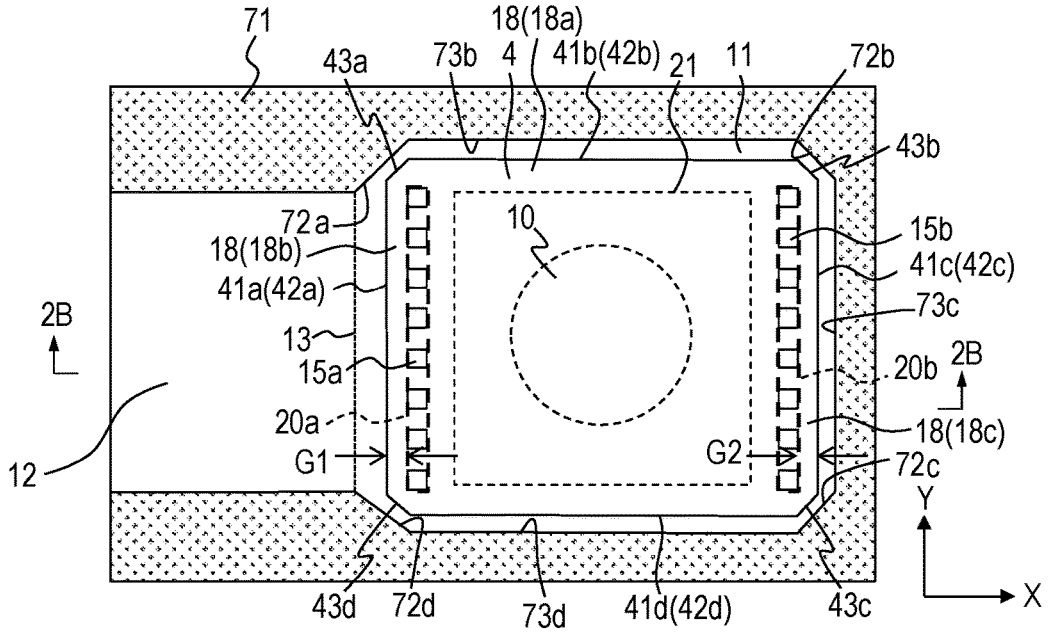
FIGS. 2A and 2B are a schematic partial plan view and a schematic partial cross-sectional view of the liquid ejection head illustrated in FIG. 1.
Figure 2B:
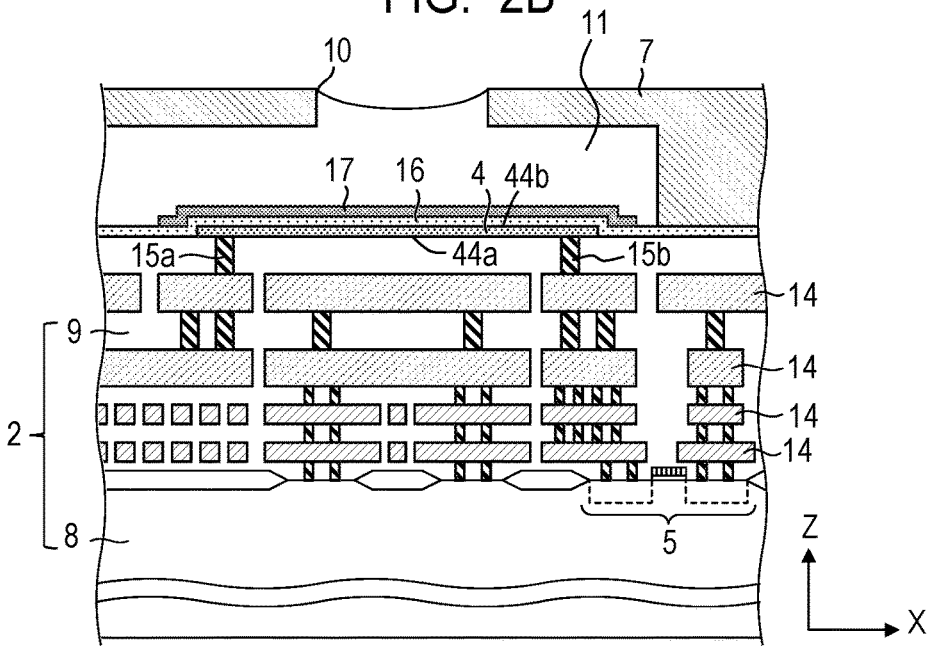
Figure 3:
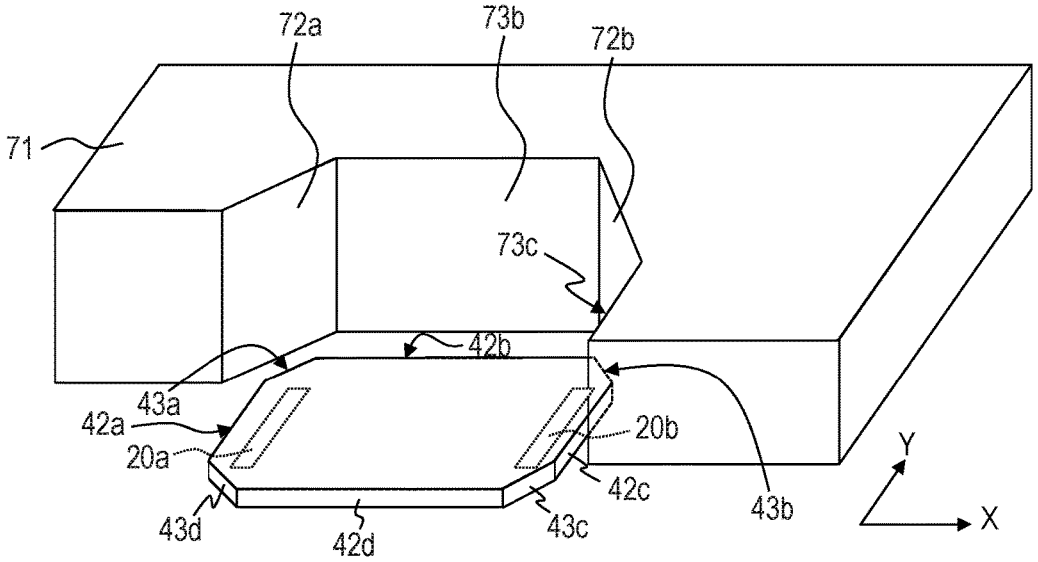
FIG. 3 is a schematic partial perspective view of the liquid ejection head illustrated in FIG. 1.

FIG. 2A is an enlarged schematic plan view of part 2A illustrated in FIG. 1 and FIG. 2B is a schematic cross-sectional view taken along line 2B-2B in FIG. 2A. FIG. 3 is a schematic perspective view of part 2A illustrated in FIG. 1. The liquid ejection head 1 includes a substrate 2 and an ejection port forming member (flow channel forming member) 7. The substrate 2 includes an SiO substrate 8 that is made of SiO, which is an insulator, and an insulation film 9 formed on the SiO substrate 8. The heat generating resistor elements 4 are formed on the insulation film 9. The heat generating resistor elements 4 are made of a Ta compound, which may typically be TaSiN. As viewed in the Z-direction, each of the heat generating resistor elements 4 shows a substantially rectangular plan view. More specifically, each of the heat generating resistor elements 4 has first and third sides 41*a* and 41*c* that run in parallel with each other and second and fourth sides 41*b* and 41*d* that run in parallel with each other and orthogonally relative to the first and third sides 41*a* and 41*c*. Note, however, that the first side 41*a* and the third side 41*c* may not necessarily be in parallel with each other in the strict sense of the word and, similarly, the second side 41*b* and the fourth side 41*d* may not necessarily be in parallel with each other in the strict sense of the word. Further, the first and third sides 41*a* and 41*c* may not necessarily be orthogonal to the second and fourth sides 41*b* and 41*d* in the strict sense of the word. Differently stated, each of the heat generating resistor elements 4 shows a substantially rectangular profile and has the first and third sides 41*a* and 41*c* that run substantially in parallel with each other and the second and fourth sides 41*b* and 41*d* that extend substantially in parallel with each other in a direction different from the direction in which the first and third sides 41*a* and 41*c* extend.

Each of the heat generating resistor elements 4 has a film thickness in the Z-direction and hence shows a substantially rectangularly parallelepipedic profile. Each of the heat generating resistor elements 4 has first through fourth side surfaces 42*a* through 42*d* that respectively correspond to the first through fourth sides 41*a* through 41*d* and first through fourth convex corners 43*a* through 43*d*. The first convex corner 43*a* is located between the first side surface 42*a* and the second side surface 42*b* and the second convex corner 43*b* is located between the second side surface 42*b* and the third side surface 42*c*, while the third convex corner 43*c* is located between the third side surface 42*c* and the fourth side surface 42*d* and the fourth convex corner 43*d* is located between the fourth side surface 42*d* and the first side surface 42*a*. Furthermore, each of the heat generating resistor elements 4 has a substrate-facing surface 44*a* that faces the substrate 2 and a bubble forming chamber-facing surface 44*b* that is the surface opposite to the substrate-facing surface 44*a* and facing the bubble forming chamber 11, which will be described in greater detail hereinafter.

An ejection port forming member 7 is arranged at the side of the surface of the insulation film 9 on which the heat generating resistor elements 4 are formed. The ejection port forming member 7 has ejection ports 10 that respectively correspond to the heat generating resistor elements 4. The ejection port forming member 7 forms with the substrate 2 a plurality of bubble forming chambers 11 that are held in communication with the corresponding respective ejection ports 10. An ink supply flow channel (liquid supply channel) 12 for supplying ink to the bubble forming chambers 11 is formed between the substrate 2 and the ejection port forming member 7. The bubble forming chambers 11 communicate with the ink supply port 3 by way of the ink supply flow channel 12 and the ink supplied from the ink supply port 3 is introduced into the bubble forming chambers 11 by way of the ink supply flow channel 12. The side of each of the bubble forming chambers 11 that is located opposite to its connecting part 13 connected to the ink supply flow channel 12 is a dead end. The side wall 71 of the ejection port forming member 7 has the first concave corners 72*a* that are respectively located vis-à-vis the corresponding first convex corners 43*a* of the heat generating resistor elements 4, the second concave corners 72*b* that are respectively located vis-à-vis the corresponding second convex corners 43*b* of the heat generating resistor elements 4, the third concave corners 72*c* that are respectively located vis-à-vis the corresponding third convex corners 43*c* of the heat generating resistor elements 4 and the fourth concave corners 72*d* that are respectively located vis-à-vis the corresponding fourth convex corners 43*d* of the heat generating resistor elements 4. The side wall 71 of the ejection port forming member 7 additionally has the second wall surfaces 73*b* that are respectively located vis-à-vis the corresponding second side surfaces 42*b* of the heat generating resistor elements 4, the third wall surfaces 73*c* that are respectively located vis-à-vis the corresponding third side surfaces 42*c* of the heat generating resistor elements 4 and the fourth wall surfaces 73*d* that are respectively located vis-à-vis the corresponding fourth side surfaces 42*d* of the heat generating resistor elements 4. Because the first side surfaces 42*a* of the heat generating resistor elements 4 face the ink supply flow channel 12, no side wall 71 of the ejection port forming member 7 is found at the positions facing the first side surfaces 42*a*.

Electric wirings 14 for supplying an electric current to the heat generating resistor elements 4 extend in the insulation film 9. The electric wirings 14 are buried in the insulation film 9. The electric wirings 14 are typically formed so as to contain aluminum. The electric wirings 14 electrically connect the heat generating resistor elements 4 to the drive circuits 5 by way of first and second connecting members 15*a* and 15*b*, which will be described in greater detail hereinafter. Each of the heat generating resistor elements 4 is driven to generate heat by the electric current supplied from the drive circuits 5 and, as the heat generating resistor element 4 becomes hot, it in turn heats the ink contained in the corresponding one of the bubble forming chambers 11 and causes the ink to give rise to film boiling. Then, the ink located near the ejection port 10 is ejected from the ejection port 10 for a recording operation by the bubbles generated by the film boiling.

With regard to each of the heat generating resistor elements 4, the heat generating resistor element 4 is covered by a protective film 16 that is made of SiN. The protective film 16 may alternatively be made of SiO or SiC. The protective film 16 is covered by an anti-cavitation film 17 that is typically made of a metal material such as Ta. The anti-cavitation film 17 may alternatively be made of Ir or formed as laminated film of Ta and Ir. Note that the protective film 16 and the anti-cavitation film 17 are omitted from the partial plan views of the liquid ejection head such as FIG. 2A and also from FIG. 3 for the purpose of representing the profile of the heat generating resistor element 4 in a comprehensible manner.

A plurality of first connecting members 15*a* and a plurality of second connecting members 15*b* are arranged in the insulation film 9. The first and second connecting members 15*a* and 15*b* extend in the insulation film 9 in the film thickness direction (in the Z-direction) to connect the heat generating resistor elements 4 to the electric wirings 14. As viewed in the Z-direction from the side of the ejection port forming member 7, the first and second connecting members 15*a* and 15*b* are covered by the heat generating resistor element 4. The first connecting member 15*a* connects the heat generating resistor element 4 to the electric wiring 14 located near the first side 41*a* of the heat generating resistor element 4, whereas the second connecting member 15*b* connects the heat generating resistor element 4 to the electric wiring 14 located near the third side 41*c* of the heat generating resistor element 4. Thus, an electric current flows through the heat generating resistor element 4 in the first direction or the X-direction.

The first and second connecting members 15*a* and 15*b* are plugs extending from the electric wirings 14 in the Z-direction. In this embodiment, the first and second connecting members 15*a* and 15*b* represent a substantially square cross section, although the corners thereof may be rounded or they may alternatively represent a cross section other than square such as rectangular, circular or elliptic. While the first and second connecting members 15*a* and 15*b* are made of tungsten, they may alternatively be made of titanium, platinum, cobalt, nickel, molybdenum, tantalum, silicon or a compound of any of them. The first and second connecting members 15*a* and 15*b* may integrally be formed with the electric wirings 14. More specifically, the connecting members 15*a* and 15*b* may integrally be formed with the electric wirings 14 by partly notching the electric wirings 14 in the thickness direction, which is the Z-direction. The plurality of first connecting members 15*a* are arranged along the second direction, which is the Y-direction, at intervals. Similarly, the plurality of second connecting members 15*b* are arranged along the second direction, which is the Y-direction, at intervals. The first and second connecting members 15*a* and 15*b* may be united to an electrically conductive member that extends in the second direction, which is the Y-direction.

The first connecting members 15*a* are separated from the first side 41*a* (the first side surface 42*a*) of the heat generating resistor element 4 by a distance of G1 and electrically connected to the heat generating resistor elements 4. Similarly, the second connecting members 15*b* are separated from the third side 41*c* (the third side surfaces 42*c*) of the heat generating resistor element 4 by a distance of G2 and electrically connected to the heat generating resistor element 4. While the distance G1 and the distance G2 are equal to each other in FIG. 2A, they may alternatively differ from each other. Thus, a first electrical connection region 20*a* for supplying electric energy to the heat generating resistor element 4 is arranged along the first side 41*a* (the first side surface 42*a*) and separated from the first side 41*a* (the first side surface 42*a*) by the distance G1 on the substrate-facing surface 44*a* of the heat generating resistor element 4. Additionally, a second electrical connection region 20*b* for supplying electric energy to the heat generating resistor element 4 is arranged along the third side 41*c* (the third side surface 42*c*) and separated from the third side 41*c* (the third side surface 42*c*) by the distance G2 on the substrate-facing surface 44*a*. The first electrical connection region 20*a* is separated from the first side 41*a* (the first side surface 42*a*) by the distance G1 in order to reliably connect the first connecting members 15*a* to the heat generating resistor element 4. The second electrical connection region 20*b* is separated from the third side 41*c* (the third side surface 42*c*) by the distance G2 for the same reason. The first electrical connection region 20*a* is the smallest rectangular region that includes all the first connecting members 15*a* and whose four sides are circumscribed to at least some of the first connecting members 15*a*. Similarly, the second electrical connection region 20*b* is the smallest rectangular region that includes all the second connecting members 15*b* and whose four sides are circumscribed to at least some of the second connecting members 15*b*. While the first and second electrical connection regions 20*a* and 20*b* extend along the second direction, which is the Y-direction, in FIG. 2A, they may not extend along the second direction, which is the Y-direction. In other words, the first and second electrical connection regions 20*a* and 20*b* may alternatively extend in a direction that obliquely intersects the first direction, which is the X-direction.

In the heat generating resistor element 4, the region that actually takes part in forming ink bubbles, namely the ink bubble forming region, is referred to as bubble forming region 21. The dimension of the bubble forming region 21 in the X-direction and the dimension thereof in the Y-direction are determined by the peripheral structure of the heat generating resistor element 4, the thermal conductivity of the heat generating resistor element 4 and other factors. The bubble forming region 21 is located inside relative to the edges (the first through fourth sides 41*a* through 41*d*) of the heat generating resistor element 4 and the region located between the bubble forming region 21 and the heat generating resistor element 4 does not take part in forming ink bubbles (to be referred to as frame region 18 hereinafter). Of the frame region 18, the regions 18*a* located between the first electrical connection region 20*a* and the second electrical connection region 20*b* generate heat as a result of electric energization but ink does not form bubbles there because the generated heat is mostly radiated to the surrounding area. Of the frame region 18, the region 18*b* between the first electrical connection region 20*a* and the first side 41*a* and the region 18*c* between the second electrical connection region 20*b* and the third side 41*c* are not electrically energized at all. Therefore, these regions 18*b* and 18*c* are non-heat generating regions and hence ink does not form bubbles in these regions. Thus, the non-heat generating regions 18*b* and 18*c* are remainder regions that provide clearances for the first and second connecting members 15*a* and 15*b* to reliably be electrically connected to the heat generating resistor element 4.

Figure 4A:
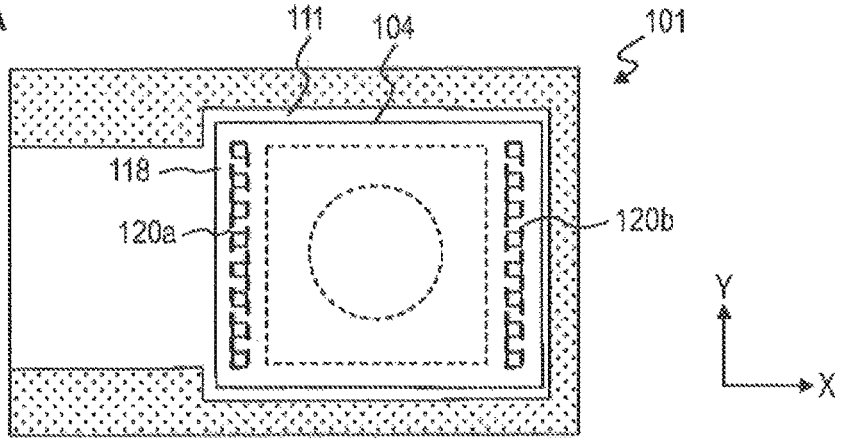
FIGS. 4A, 4B and 4C are schematic partial plan views of the liquid ejection heads of Comparative Examples.

FIG. 4A is a schematic plan view of the liquid ejection head 101 of Comparative Example 1, in which the first and second electrical connection regions 120*a* and 120*b* are arranged on the substrate-facing surface 44*a* of each of the heat generating resistor element 4 (104). FIG. 4A is a schematic plan view similar to FIG. 2A. The configurations of the first and second electrical connection regions 120*a* and 120*b* of Comparative Example 1 are the same as the configurations of the first and second electrical connection regions 20*a* and 20*b* of the first embodiment. The bubble forming chamber 111 is rectangular just like the bubble forming chamber of the prior art and the heat generating resistor element 104 also represents a rectangular plan view. As pointed out earlier, each of the heat generating resistor elements 4 (104) of the liquid ejection head 101 having the above-described configuration has a large frame region 118 where ink does not form bubbles and hence the ink that is held in contact with the frame region 118 is hardly moved by bubble formation. In other words, ink is apt to become stagnant there. Ink is apt to become stagnant particularly at the four corners of the bubble forming chamber 111. An area where ink is apt to become stagnant can easily give rise to a bubble pool. A bubble pool absorbs the bubble forming pressure and makes it difficult to give rise to desired bubble forming pressure. In other words, bubble pools can adversely affect the ink ejection performance of the liquid ejection head in terms of the ink ejection capacity, the ink ejection speed and so on. Additionally, such bubble pools can become a droplet forming process-obstructing factor for ejected ink.

Figure 4B:
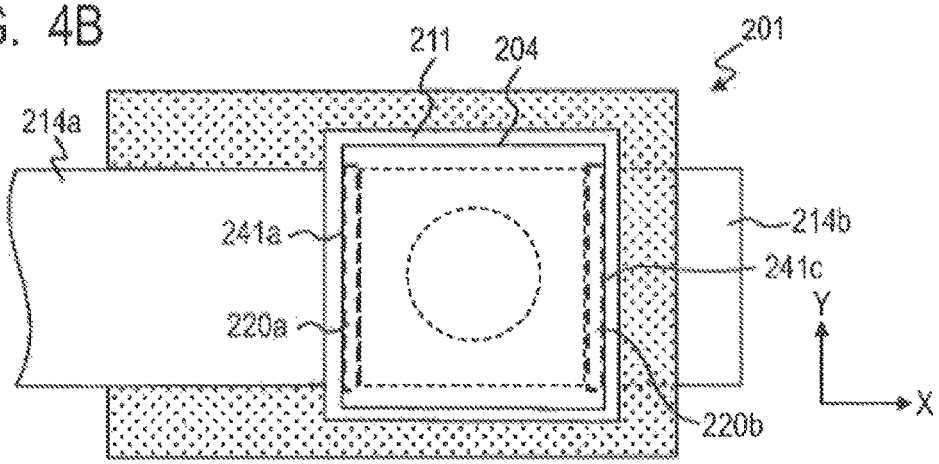

FIG. 4B is a schematic plan view of a part of the liquid ejection head 201 of Comparative Example 2 similar to FIG. 2A. FIG. 4B illustrates one of the heat generating resistor elements 4 (204) of the liquid ejection head 201 and the first and second electrical connection regions 220*a* and 220*b* arranged on the bubble forming chamber-facing surface 44*a* of the heat generating resistor element 4 (204). The bubble forming chamber 211 is rectangular just like the bubble forming chamber of the prior art and the heat generating resistor element 204 also represents a rectangular plan view. The first and second electric wirings 214*a* and 214*b* are arranged on the bubble forming chamber-facing surface 44*b* of the heat generating resistor element 204 so as to cover the first side 241*a* and the third side 241*c* of the heat generating resistor element 204. In each of the heat generating resistor elements 204 of a liquid ejection head 201 having the above-described configuration, the electrical connection regions 220*a* and 220*b* are arranged so as to respectively extend from the first side 241*a* and the third side 241*c* of the heat generating resistor element 204 to eliminate the need of arranging remainder regions as described above so that the width of the frame region in the X-direction can be made smaller than the width of the frame region of Comparative Example 1. Then, the stagnant regions are smaller than the stagnant regions of Embodiment 1 and those of Comparative Example 1 so that the bubble pool producing regions can be reduced. On the other hand, such an arrangement gives rise to a difference in level at the edges where the electric wirings 214*a* and 214*b* are connected to the heat generating resistor element 204 as pointed out earlier. Then, the film thickness of the protective film 16 is liable to become greater. A thick protective film 16 is disadvantageous from the viewpoint of power consumption.

To the contrary, each of the first concave corners 72*a* of the ejection port forming member 7 consists of the first oblique surface 72*a* that is obliquely connected to the second wall surface 73*b* in this embodiment. Similarly, the second concave corner 72*b* consists of the second oblique surface 72*b* that is obliquely connected to the second wall surface 73*b* and the third wall surface 73*c*. Then, the third concave corner 72*c* consists of the third oblique surface 72*c* that is obliquely connected to the third wall surface 73*c* and the fourth wall surface 73*d*. Finally, the fourth concave corner 72*d* consists of the fourth oblique surface 72*d* that is obliquely connected to the fourth wall surface 73*d*. In short, the first through fourth concave corners 72*a* through 72*d* are comprised of oblique surfaces that are oblique relative to all of the first side 41*a* through the fourth side 41*d* (the first side surface 42*a* through the fourth side surface 42*d*). Differently stated, the first through fourth concave corners 72*a* through 72*d* are comprised of surfaces that extend obliquely to the first side 41*a* through the fourth side 41*d* (the first side surface 42*a* through the fourth side surface 42*d*), respectively.

Figure 5:
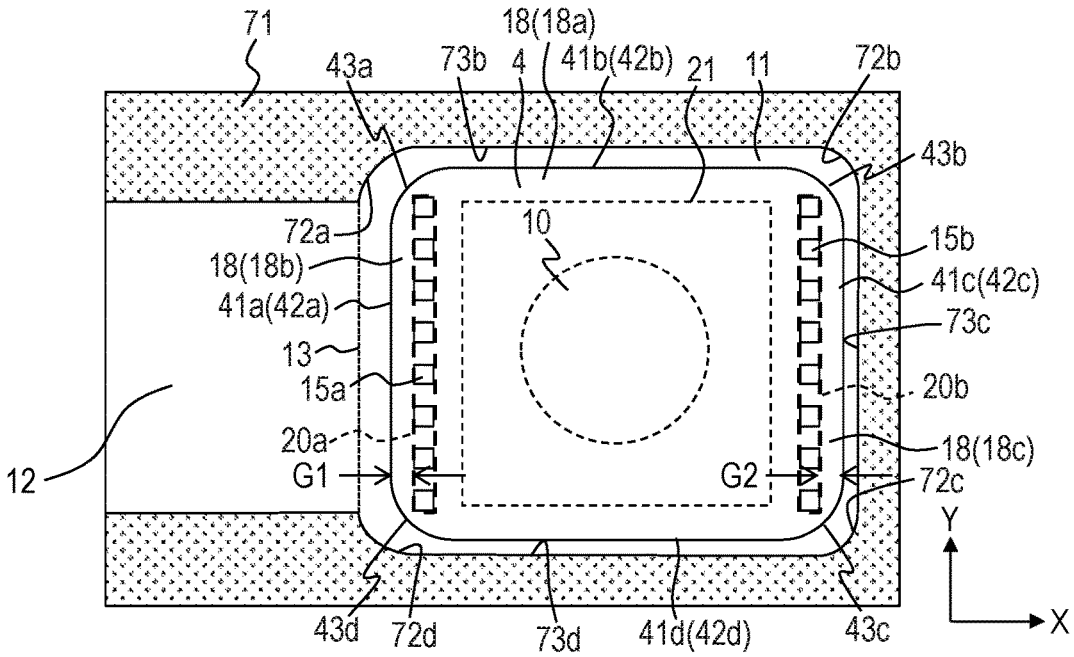
FIG. 5 is a schematic partial plan view of a liquid ejection head obtained by modifying the liquid ejection head illustrated in FIG. 2A.

Referring to FIG. 5 that illustrates an exemplary modification of this embodiment, the first through fourth concave corners 72*a* through 72*d* may be curved surfaces. In other words, the first through fourth concave corners 72*a* through 72*d* may be rounded. While all of the first through fourth concave corners 72*a* through 72*d* are comprised of oblique surfaces or curved surfaces in this embodiment, it is sufficient that at least one of the first through fourth concave corners 72*a* through 72*d* is comprised of an oblique surface or a curved surface. Alternatively, only one, two or three of the first through fourth concave corners 72*a* through 72*d* may be comprised of an oblique surface or oblique surfaces and the remaining concave corners or corner may be comprised of curved surfaces or a curved surface.

In this embodiment, at least one concave corner of the side wall is comprised of a curved surface or an oblique surface that is oblique relative to a pair of sides. In other words, at least one of the concave corners of the bubble forming chamber 11 represents a rounded or chamfered profile. For this reason, the area of the non-heat generating region of such a concave corner is reduced to suppress stagnation of liquid at the concave corner and the consequent occurrence of a bubble pool.

Additionally, in this embodiment, the first through fourth convex corners 43*a* through 43*d* of the heat generating resistor element 4 are chamfered (FIG. 2A) or rounded (FIG. 5) to match the profiles of the first through fourth concave corners 72*a* through 72*d*. Preferably, the first through fourth convex corners 43*a* through 43*d* are chamfered or rounded as much as possible provided that the first and second connecting members 15*a* and 15*b* can electrically be connected to the heat generating resistor element 4. Furthermore, the second through fourth wall surfaces 73*b* through 73*d* of the ejection port forming member 7 are preferably arranged as close as possible relative to the bubble forming region 21. When the first through fourth concave corners 72*a* through 72*d* of the ejection port forming member 7 are oblique surfaces, the first through fourth convex corners 43*a* through 43*d* are preferably linearly chamfered. When, on the other hand, the first through fourth concave corners 72*a* through 72*d* of the ejection port forming member 7 are curved surfaces, the first through fourth convex corners 43*a* through 43*d* are preferably rounded.

However, the first through fourth convex corners 43*a* through 43*d* of the heat generating resistor element 4 may be rounded even when the first through fourth concave corners 72*a* through 72*d* of the ejection port forming member 7 are oblique surfaces. Similarly, the first through fourth convex corners 43*a* through 43*d* of the heat generating resistor element 4 may be linearly chamfered even when the first through fourth concave corners 72*a* through 72*d* of the ejection port forming member 7 are curved surfaces. Note that, from the viewpoint of allowing liquid to flow easily, the first through fourth concave corners 72*a* through 72*d* of the ejection port forming member 7 are preferably curved surfaces. To make the non-heat generating regions of the heat generating resistor element 4 as small as possible, the first through fourth convex corners 43*a* through 43*d* of the heat generating resistor element 4 are preferably linearly chamfered. In other words, preferably, the first through fourth concave corners 72*a* through 72*d* of the ejection port forming member 7 that are curved surfaces (FIG. 5) and the first through fourth convex corners 43*a* through 43*d* of the heat generating resistor element 4 that are linearly chamfered (FIG. 2A) are combined for use. Additionally note that, when the first through fourth concave corners 72*a* through 72*d* of the ejection port forming member 7 are neither oblique surfaces nor curved surfaces, it is not necessary to chamfer or round the corresponding first through fourth convex corners 43*a* through 43*d* of the heat generating resistor element 4.

Figure 4C:
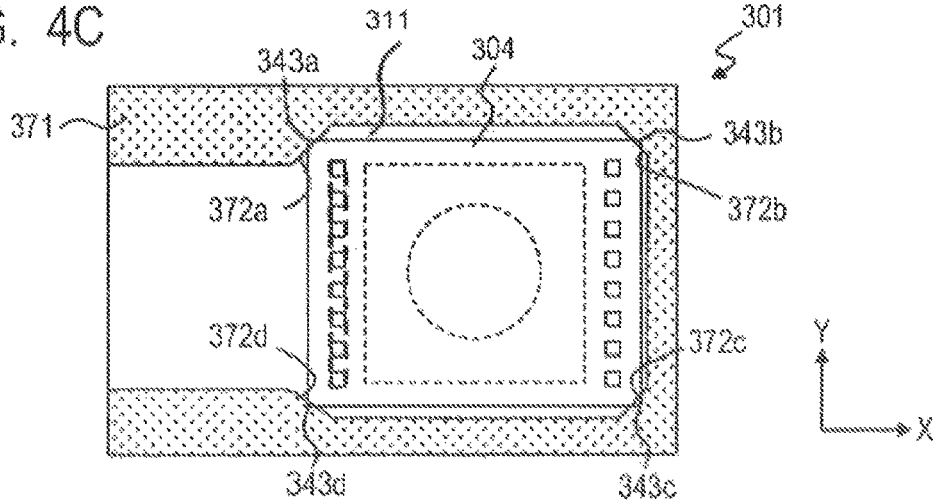

FIG. 4C is a schematic plan view of the liquid ejection head 301 of Comparative Example 3 similar to FIG. 2A. The first through fourth concave corners 372*a* through 372*d* of the bubble forming chamber 311 are comprised of oblique surfaces. The convex corners 343*a* through 343*d* of the heat generating resistor element 304 are not chamfered. Consequently, then, the side wall 371 of the ejection port forming member is arranged so as to respectively cross the convex corners 343*a* through 343*d* of the heat generating resistor element 304. Thus, since the side wall 371 of the ejection port forming member crosses the steps of the convex corners 343*a* through 343*d* of the heat generating resistor element 304, the risk that peeling starts from any of the steps rises. To the contrary, of the first through fourth convex corners 43*a* through 43*d* of the heat generating resistor element 4 of this embodiment, those that face the oblique surfaces or the curved surfaces out of the first through fourth concave corners 72*a* through 72*d* are chamfered or rounded. Then, as a result, the side wall 71 of the ejection port forming member 7 is located outside of the heat generating resistor element 4 and the concave corners of the side wall 71 do not overlap the corresponding respective convex corners of the heat generating resistor element 4 in the plan view of the substrate 2. Thus, the side wall 71 of the ejection port forming member 7 does not interfere with the heat generating resistor element 4 and hence the above-identified problem can be avoided.

Second Embodiment

Figure 6A:
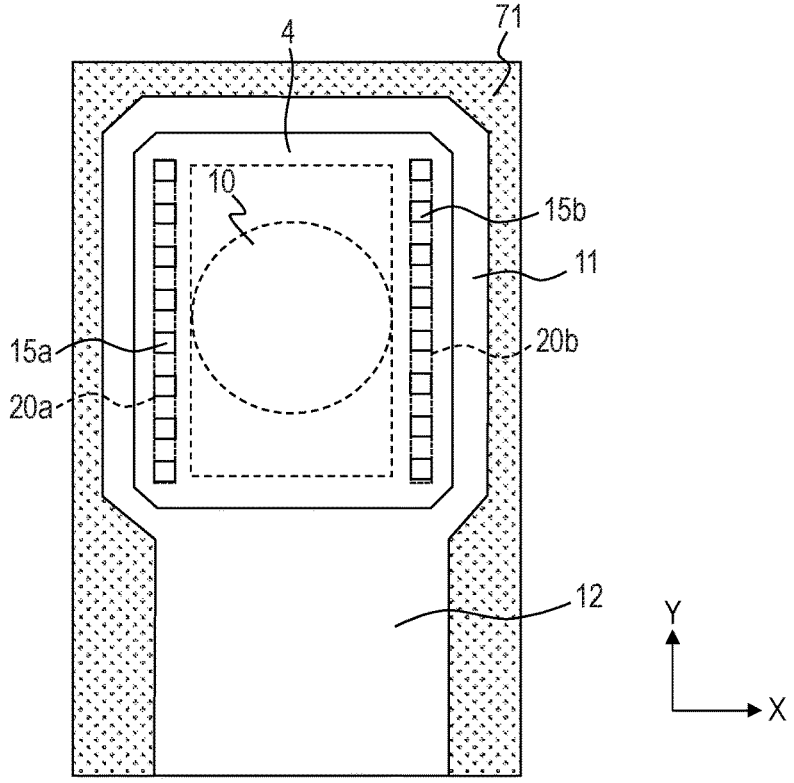
FIGS. 6A and 6B are schematic partial plan views of two liquid ejection heads of the second embodiment according to the present invention.
Figure 6B:
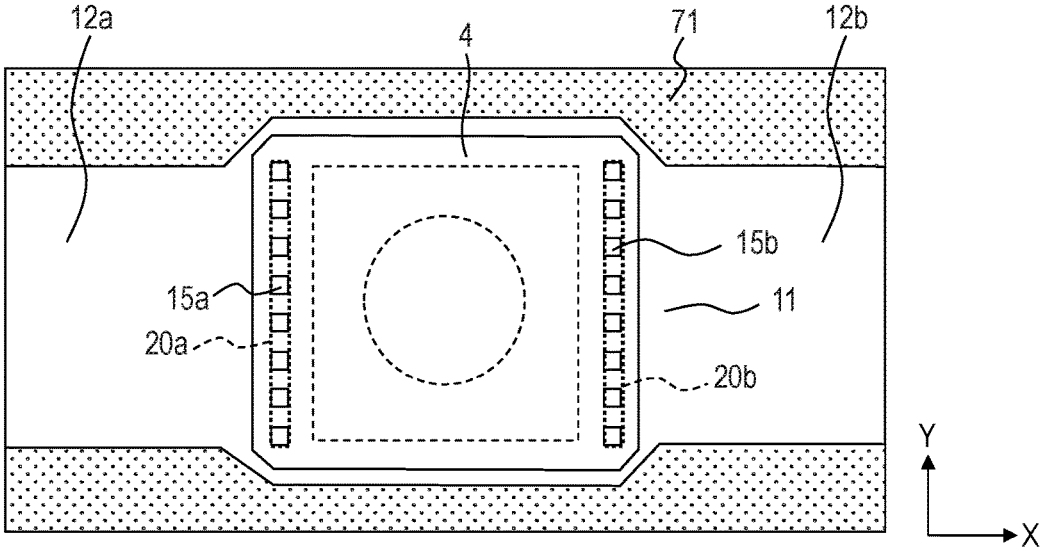

FIGS. 6A and 6B are schematic plan views of two liquid ejection heads of the second embodiment of the present invention, which are similar to FIG. 2A. The parts of the configurations of this embodiment that are not described below are the same as those of the first embodiment. In other words, the second embodiment is described below only in terms of the differences between the first embodiment and the second embodiment. In the instance illustrated in FIG. 6A, the first and second electrical connection regions 20*a* and 20*b* extend along the direction in which ink is supplied, preferably in parallel with the direction in which the ink is supplied. In other words, the direction in which ink is supplied orthogonally intersects the direction in which the electric current flows to electrically energize the heat generating resistor element 4. In the instance illustrated in FIG. 6B, a pair of liquid flow channels 12*a* and 12*b* are arranged between the substrate 2 and (the side wall 71 of) the ejection port forming member 7 and at the opposite sides of the bubble forming chamber 11. Each of the liquid flow channels 12*a* and 12*b* is held in communication with the bubble forming chamber 11. The pair of liquid flow channels 12*a* and 12*b* represent respective profiles that are linearly symmetric relative to the Y-directional axis. The first and second electrical connection regions 20*a* and 20*b* extend in a direction that intersects, preferably orthogonally intersects, the liquid flow direction. Ink is supplied to the bubble forming chamber 11 by way of one of the liquid flow channels 12*a* and 12*b*, the liquid flow channel 12*a* to be more specific, and the ink that is left unejected is discharged from the bubble forming chamber 11 by way of the other liquid flow channel 12*b*. Ink may be made to circulate between the bubble forming chamber 11 and the outside of the bubble forming chamber 11. It may alternatively be so arranged that ink is supplied to the bubble forming chamber 11 by way of both of the liquid flow channels 12*a* and 12*b*. Still alternatively, in the instance of FIG. 6B, the first and second electrical connection regions 20*a* and 20*b* may be so arranged as to extend along the direction in which ink flows, preferably in parallel with the direction in which ink flows.

Third Embodiment

Figure 7A:
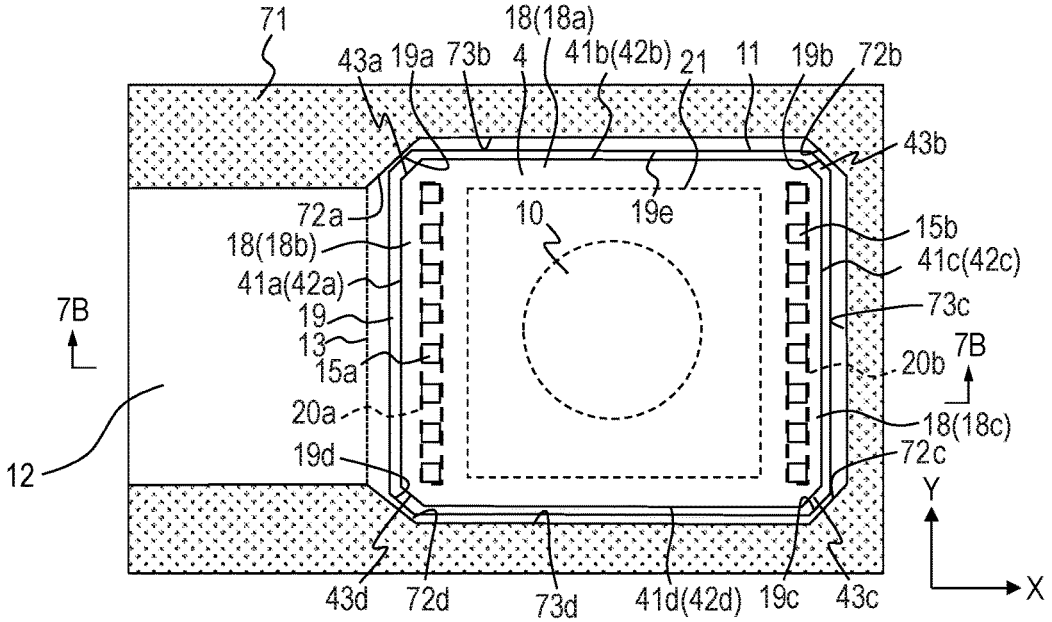
FIGS. 7A and 7B are a schematic partial plan view and a schematic partial cross-sectional view of the third embodiment of liquid ejection head according to the present invention.
Figure 7B:
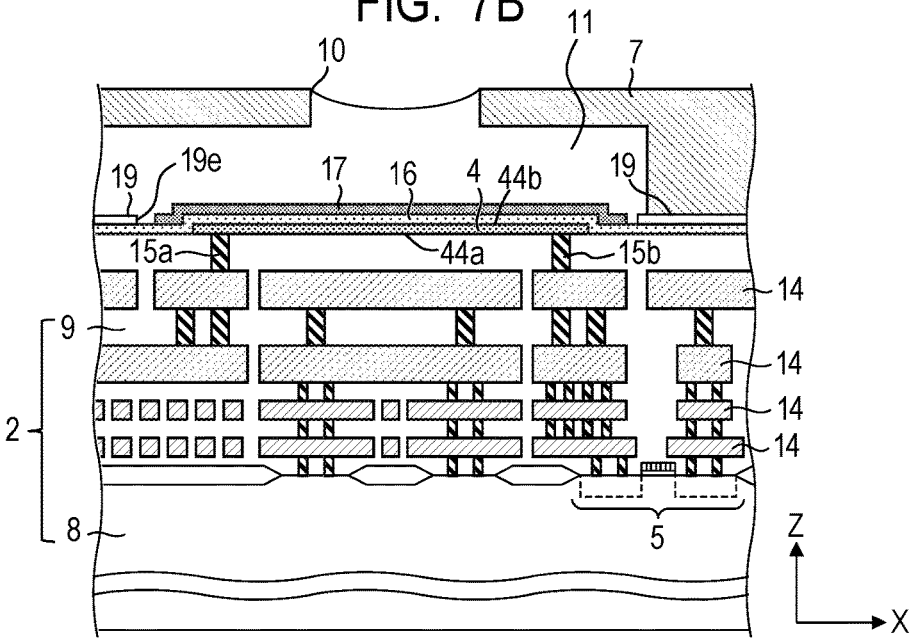

FIGS. 7A and 7B schematically illustrate the third embodiment of the present invention. They are similar to FIGS. 2A and 2B. The parts of the configuration of this embodiment that are not described below are the same as the corresponding parts of the configuration of the first embodiment. In other words, the third embodiment is described below only in terms of the differences between the first embodiment and the third embodiment. An adhesion enhancing layer 19 is provided in this embodiment to improve the adhesion between the ejection port forming member 7 and the substrate 2. The adhesion enhancing layer 19 is an intermediate layer arranged between the ejection port forming member 7 and the substrate 2. The adhesion enhancing layer 19 is located between the side wall 71 of the ejection port forming member 7 and the substrate 2 and represents a profile similar to the profile of the bottom surface of the side wall 71 of the ejection port forming member 7. Accordingly, the adhesion enhancing layer 19 has an inside edge 19*e* that faces the inner surface of the side wall 71 and hence the edge (the sides 41*b* through 41*d* in FIG. 7A) of the heat generating resistor element 4 and an outside edge (not illustrated) that faces the outer surface of the side wall 71. Since the inside edge 19*e* of the adhesion enhancing layer 19 is arranged between and along the side wall 71 of the ejection port forming member 7 and the heat generating resistor element 4, all of the bottom surface of the side wall 71 of the ejection port forming member 7 contacts the adhesion enhancing layer 19. The inside edge 19*e* of the adhesion enhancing layer 19 is formed along the contour of the side wall 71 of the ejection port forming member 7. In other words, since the side wall 71 of the ejection port forming member 7 is arranged so as to never cross the inside edge 19*e* of the adhesion enhancing layer 19, any peeling starting from the inside edge 19*e* of the adhesion enhancing layer 19 can be prevented from taking place. The convex corners 19*a* through 19*d* of the adhesion enhancing layer 19 that respectively face the first through fourth concave corners 72*a* through 72*d* of the side wall 71 are chamfered or rounded just like the convex corners of the heat generating resistor element 4. Due to the above-described arrangement, the ejection port forming member 7 is formed on the adhesion enhancing layer 19 without fail and the area of the non-heat generating regions is limited so that the occurrences of bubble pools are suppressed. Note that the adhesion enhancing layer 19 is only required to improve the adhesion between the ejection port forming member 7 and the substrate 2 and hence can be formed by using a material selected from resin materials and inorganic materials. A plurality of adhesion enhancing layers 19 that are made of different materials may be provided. If such is the case, the inside edges 19*e* of the adhesion enhancing layers 19 are also required to be arranged so as to run between and along the side wall 71 of the ejection port forming member 7 and the heat generating resistor element 4.

Fourth Embodiment

Figure 8:
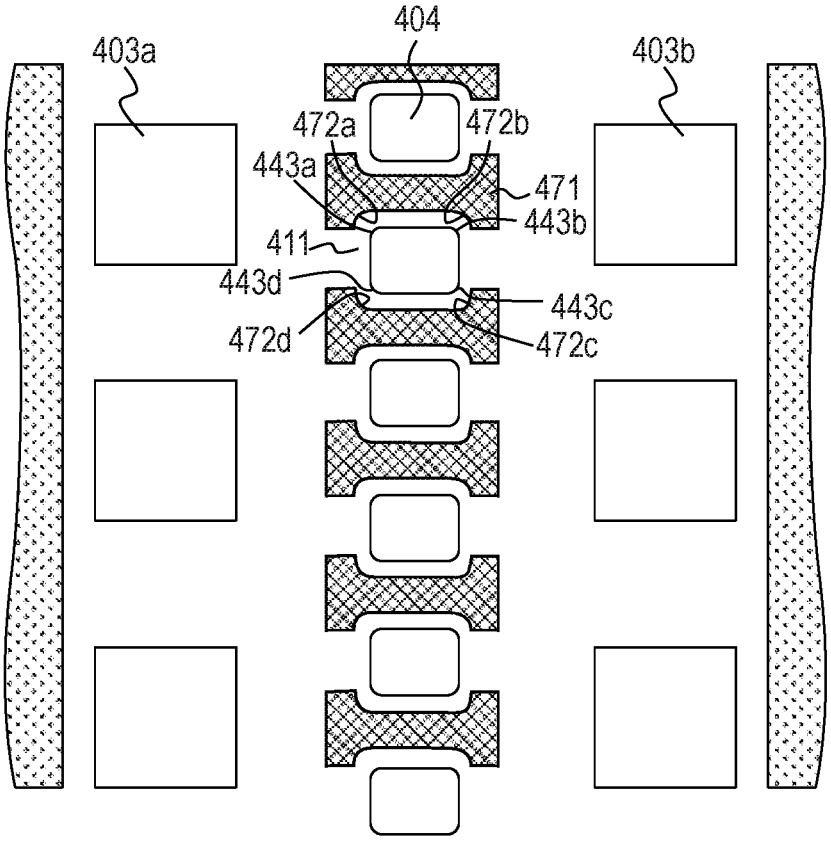
FIG. 8 is a schematic partial plan view of the fourth embodiment of liquid ejection head according to the present invention.

FIG. 8 is a schematic partial plan view of the fourth embodiment of liquid ejection head according to the present invention. Referring to FIG. 8, a plurality of heat generating resistor elements 404 are arranged in a row and a plurality of ink supply ports 403*a* are arranged in a row running along the row of the heat generating resistor elements 404 at one of the opposite sides thereof, while a plurality of ink discharge ports 403*b* are arranged in a row running along the row of the heat generating resistor element 404 at the other side thereof. With this arrangement, ink may be made to circulate between each of the bubble forming chambers 11 (411) and the outside of the bubble forming chamber 11. Alternatively, the ink discharge ports 403*b* may be employed as so many ink supply ports so as to supply ink from the ink supply ports that are located at both of the lateral sides of the row of the heat generating resistor elements 404.

Additionally, a side wall 471 is arranged between any two adjacently located heat generating resistor elements 404. In other words, a plurality of side walls 471 are arranged in a row. Thus, each of the heat generating resistor elements 404 is partly surrounded by a pair of side walls 471 that are arranged at the opposite sides of the heat generating resistor element 404 so as to be oppositely disposed relative to each other and define a bubble forming chamber 411. The concave corners 472*a* through 472*d* of the bubble forming chamber 411 are made to have curved surfaces. Furthermore, the first through fourth convex corners 443*a* through 443*d* of the heat generating resistor element 404 are also made to have curved surfaces that match the respective curved surfaces of the concave corners 472*a* through 472*d* of the bubble forming chamber 411. Thus, each of the bubble forming chambers 411 may be formed by a plurality of side walls 471 as in the instance of this embodiment. Note that the side walls 471 may be formed by using the ejection port forming member. Additionally, the concave corners 472*a* through 472*d* of each of the bubble forming chambers 411 may be comprised of curved surfaces as in the preceding embodiments. The convex corners 443*a* through 443*d* of each of the heat generating resistor elements 404 may not be curved surfaces but may be linearly chamfered.

Fifth Embodiment

Figure 9:
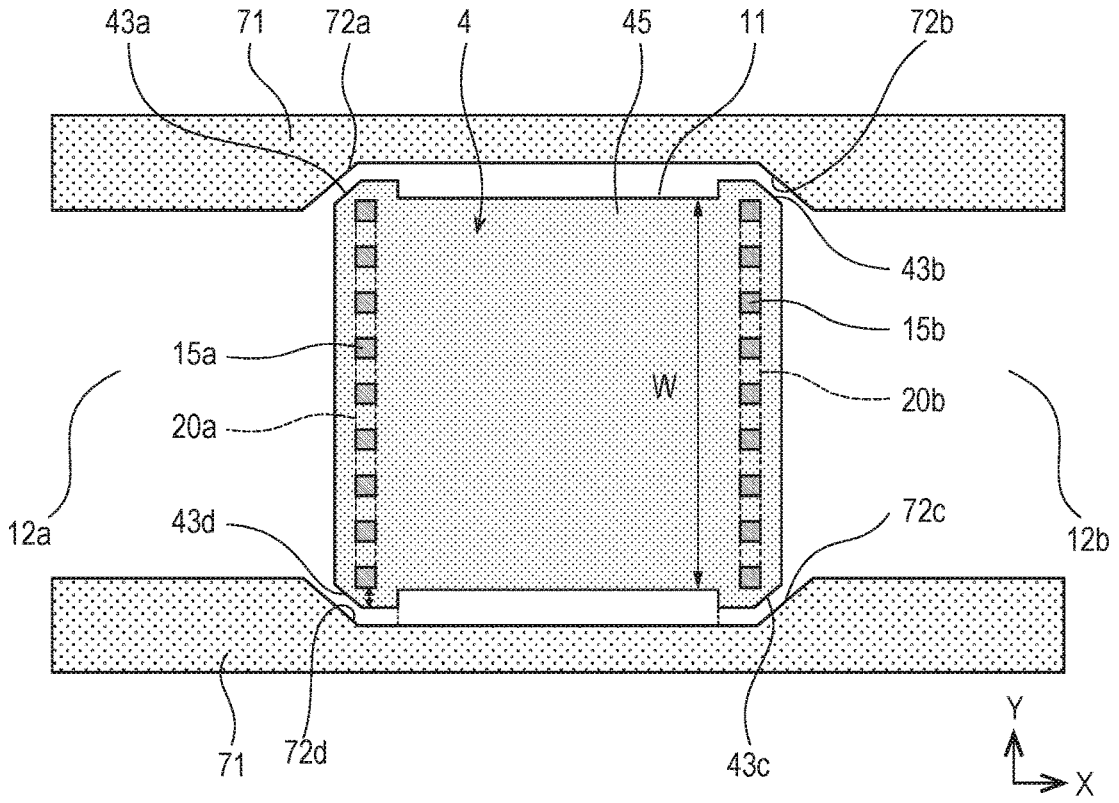
FIG. 9 is a schematic partial plan view of the fifth embodiment of liquid ejection head according to the present invention.

FIG. 9 is a schematic view of the fifth embodiment of liquid ejection head according to the present invention, which is similar to FIG. 6B. The parts of the configuration of this embodiment that are not described below are the same as those of any of the preceding embodiments. While the heat generating resistor elements of each of the preceding embodiments are described as having a substantially rectangular profile, the profile of the heat generating resistor elements of a liquid ejection head according to the present invention are not limited to the above-described ones.

For example, the heat generating resistor elements 4 of a liquid ejection head according to the present invention may represent a profile as illustrated in FIG. 9. In FIG. 9, the length in the Y-direction (in which the electrical connection regions 20*a* and 20*b* extend) of each of the parts of the heat generating resistor element 4 where the electrical connection regions 20*a* and 20*b* are arranged is greater than the length W of the center region 45 of the heat generating resistor element 4 that is sandwiched between the electrical connection regions 20*a* and 20*b*. Since the length of the electrical connection regions 20*a* and 20*b* in the Y-direction can be selected independently relative to the length of the center region 45 in the Y-direction, the connecting members 15*a* and 15*b* can be arranged in the electrical connection regions 20*a* and 20*b* without being restricted by the length of the center region 45 and the electrical connection regions 20*a* and 20*b* can be made long in the Y-direction. In the heat generating resistor element 4 having the above-described profile, the first through fourth convex corners 43*a* through 43*d* of the heat generating resistor element 4 are chamfered (FIG. 9) or rounded (not illustrated) as in the instances of the preceding embodiments. Note that the first through fourth convex corners 43*a* through 43*d* of the heat generating resistor element 4 are located outside of both of the electrical connection regions 20*a* and 20*b* as viewed both in the X-direction and in the Y-direction. Each of the first through fourth concave corners 72*a* through 72*d* of the side wall 71 of the ejection port forming member 7 that respectively face the corresponding first through fourth convex corners 43*a* through 43*d* of the heat generating resistor element 4 is comprised of an oblique surface (FIG. 9) or a curved surface (not illustrated).

Other Embodiments

Figure 10A:
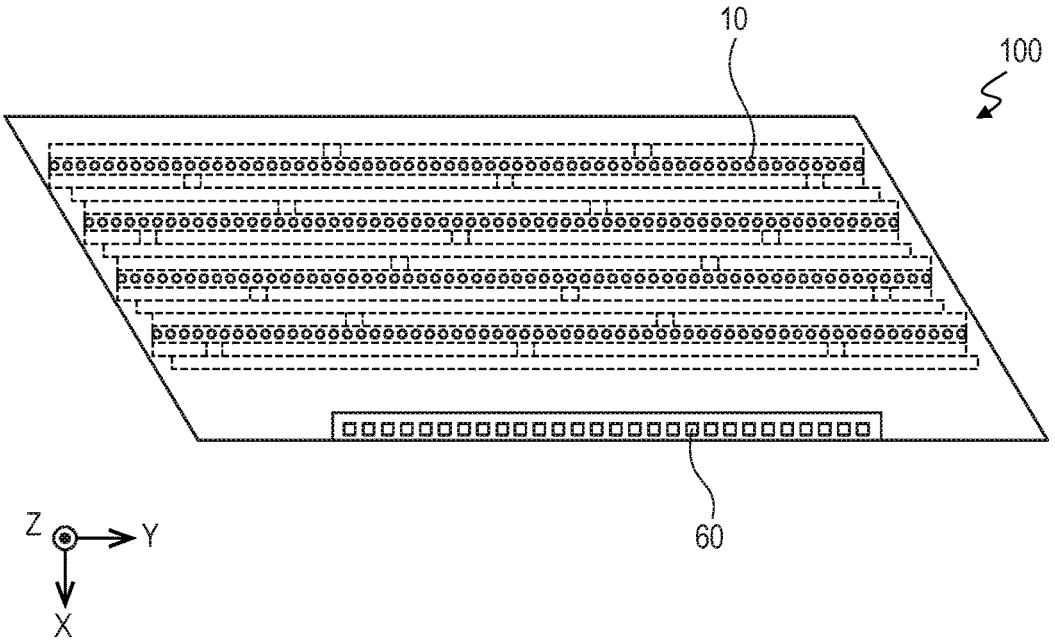
FIG. 10A is a schematic plan view of the substrate of another embodiment of liquid ejection head according to the present invention and FIG. 10B is a schematic perspective view of a liquid ejection head unit formed by using a substrate as illustrated in FIG. 10A.
Figure 10B:
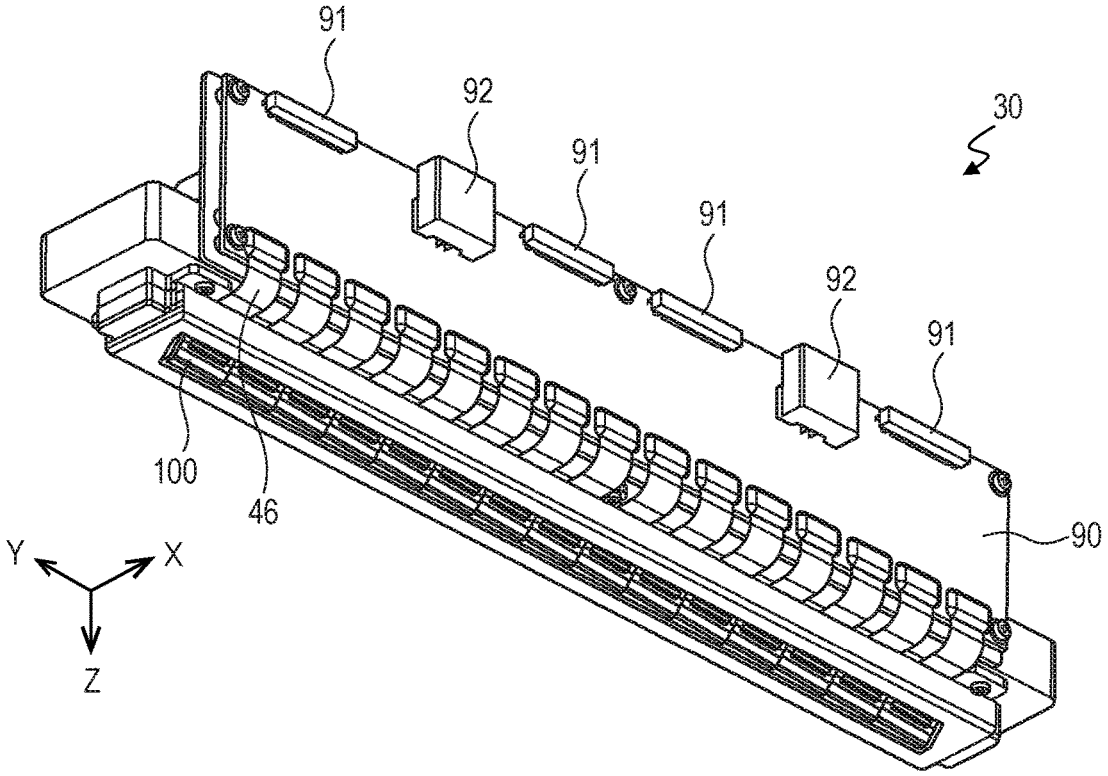

FIG. 10A schematically illustrates the substrate of a liquid ejection head 100 that differs from the substrate of any of the above-described liquid ejection heads 1. FIG. 10B is a schematic perspective view of a liquid ejection head unit 30 to which this substrate is applied.

As illustrated in FIG. 10A, the liquid ejection head 100 shows a parallelogrammatic contour, whose neighboring sides do not orthogonally intersect each other. An electrode pad 60 to be electrically connected to a flexible wiring substrate 46 is arranged at one of the opposite ends of the liquid ejection head as viewed in the X-direction. As illustrated in FIG. 10B, the liquid ejection head unit 30 is a line type liquid ejection head unit 30, on which a total of fifteen liquid ejection heads 100 are arranged on a line. The liquid ejection head unit 30 additionally includes individual flexible wiring substrates 46 that respectively correspond to the fifteen liquid ejection heads 100, signal input terminals 91 and power supply terminals 92, the signal input terminals 91 and the power supply terminals 92 being electrically connected to the respective liquid ejection heads 100 by way of a common electric wiring substrate 90. The signal input terminals 91 and the power supply terminals 92 are electrically connected to the control unit of the recording apparatus and supply ejection drive signals and electric power necessary for liquid ejection to the corresponding liquid ejection heads 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-110768, filed Jun. 5, 2017, and Japanese Patent Application No. 2018-074745, filed Apr. 9, 2018, which are hereby incorporated by reference herein in their entirety.

What is claimed is:

1. A liquid ejection head comprising: a substrate; a heat generating resistor element arranged on the substrate to generate thermal energy for ejecting liquid; and a flow channel forming member for forming a flow channel for allowing liquid to flow therethrough, the flow channel forming member having a side wall surrounding at least part of the heat generating resistor element, the heat generating resistor element having a pair of oppositely disposed sides, a pair of electrical connection regions being formed on a substrate-facing surface of the heat generating resistor element in order to supply electric energy to the heat generating resistor element, the electrical connection regions extending along the respective sides of the pair of sides and separated from the respective sides of the pair of sides by a distance, and the side wall having at least one concave corner comprised of a curved surface or a surface extending obliquely to the pair of sides, the heat generating resistor element having at least one convex corner facing the at least one concave corner of the side wall, the convex corner being rounded or chamfered.

2. The liquid ejection head according to claim 1, wherein the at least one concave corner of the side wall does not overlap the at least one convex corner of the heat generating resistor element located vis-à-vis the concave corner in a plan view of the substrate.

3. The liquid ejection head according to claim 1, wherein the heat generating resistor element shows a substantially rectangular profile in a plan view of the substrate.

4. The liquid ejection head according to claim 3, wherein all the concave corners of the side wall are comprised of curved surfaces or obliquely extending surfaces and all the convex corners of the heat generating resistor elements are rounded or chamfered.

5. The liquid ejection head according to claim 1, wherein the liquid ejection head further comprises an intermediate layer located between the side wall and the substrate, the intermediate layer having an inside edge facing the heat generating resistor element, the inside edge being located between the heat generating resistor element and the side wall.

6. The liquid ejection head according to claim 5, wherein the inside edge of the intermediate layer is comprised of a curved surface or a surface that extends obliquely to the pair of sides.

7. The liquid ejection head according to claim 1, further comprising:

a protective film covering the heat generating resistor element.

8. The liquid ejection head according to claim 7, further comprising:

an anti-cavitation film covering the protective film.

9. The liquid ejection head according to claim 1, wherein the flow channel forming member and the substrate together form a bubble forming chamber in which liquid bubbles, and the liquid ejection head further comprises a liquid supply channel located between the substrate and the flow channel forming member to supply liquid to the bubble forming chamber, the bubble forming chamber having a dead end located opposite to a connecting part connected to the liquid supply channel, the pair of electrical connection regions of the heat generating resistor element extending in a direction intersecting a liquid supplying direction.

10. The liquid ejection head according to claim 1, wherein the flow channel forming member and the substrate together form a bubble forming chamber in which liquid bubbles, and the liquid ejection head further comprises a liquid supply channel located between the substrate and the flow channel forming member to supply liquid to the bubble forming chamber, the bubble forming chamber having a dead end located opposite to a connecting part connected to the liquid supply channel, the pair of electrical connection regions of the heat generating resistor element extending in a direction running along a liquid supplying direction.

11. The liquid ejection head according to claim 1, wherein the flow channel forming member and the substrate together form a bubble forming chamber in which liquid bubbles, and the liquid ejection head further comprises a pair of liquid flow channels provided at opposite sides of the bubble forming chamber and located between the substrate and the flow channel forming member, each of the pair of liquid flow channels communicating with the bubble forming chamber, the pair of electrical connection regions of the heat generating resistor element extending in a direction intersecting a liquid communicating direction.

12. The liquid ejection head according to claim 11, wherein liquid in the bubble forming chamber is made to circulate between the inside and the outside of the bubble forming chamber by way of the pair of liquid flow channels.

13. The liquid ejection head according to claim 1, wherein the flow channel forming member and the substrate together form a bubble forming chamber in which liquid bubbles, and the liquid ejection head further comprises a pair of liquid flow channels provided at opposite sides of the bubble forming chamber and located between the substrate and the flow channel forming member, each of the pair of liquid flow channels communicating with the bubble forming chamber, the pair of electrical connection regions of the heat generating resistor element extending in a direction running along a liquid communicating direction.

14. The liquid ejection head according to claim 1, further comprising:

an insulation film provided on the substrate and having electric wiring arranged therein and a connecting member extending in the insulation film to electrically connect the electric wiring and the pair of electrical connection regions of the heat generating resistor element.

15. The liquid ejection head according to claim 14, wherein each of the pair of electrical connection regions of the heat generating resistor element is connected to a plurality of plugs as the connecting member.

16. The liquid ejection head according to claim 1, wherein the at least one concave corner of the side wall is comprised of a curved surface and the at least one convex corner of the heat generating resistor element facing the concave corner is chamfered.

17. A liquid ejection head comprising: a substrate; a heat generating resistor element arranged on the substrate to generate thermal energy for ejecting liquid; and a flow channel forming member for forming a flow channel for allowing liquid to flow therethrough, the flow channel forming member having a side wall surrounding at least part of the heat generating resistor element, the heat generating resistor element having a pair of oppositely disposed sides, a pair of electrical connection regions being formed on the substrate-facing surface of the heat generating resistor element in order to supply electric energy to the heat generating resistor element, the electrical connection regions extending along respective sides of the pair of sides and separated from the respective sides of the pair of sides by a distance, the heat generating resistor element having at least one convex corner located outside of the electrical connection regions in an extending direction of the electrical connection regions and also in a direction intersecting the extending direction, the convex corner being rounded or chamfered, and the side wall having at least one concave corner facing the at least one convex corner, the concave corner being comprised of a curved surface or a surface extending obliquely to the pair of sides.

18. The liquid ejection head according to claim 17, wherein the at least one concave corner of the side wall does not overlap the at least one convex corner of the heat generating resistor element located vis-à-vis the concave corner in a plan view of the substrate.

19. The liquid ejection head according to claim 17, wherein the heat generating resistor element shows a substantially rectangular profile in a plan view of the substrate.

20. The liquid ejection head according to claim 19, wherein all the concave corners of the side wall are comprised of curved surfaces or obliquely extending surfaces and all the convex corners of the heat generating resistor elements are rounded or chamfered.

* * * * *